United States Patent [19]

Manhart

[11] Patent Number: 4,671,415

[45] Date of Patent: Jun. 9, 1987

[54] DISPLAY STAND FOR ITEMS OF JEWELRY

[76] Inventor: Louise M. Manhart, 882-A Home Ave., Carlsbal, Calif. 92008

[21] Appl. No.: 876,072

[22] Filed: Jun. 19, 1986

[51] Int. Cl.[4] ..... A47F 7/00

[52] U.S. Cl. ..... 211/13; 211/40

[58] Field of Search ..... 211/13, 60.1, 40, 72, 211/133; D6/466, 467, 468, 469; 248/205.2; 206/481, 478, 477, 556

[56] References Cited

U.S. PATENT DOCUMENTS

| | | | |
|---|---|---|---|
| 1,239,392 | 9/1917 | Hessony | 211/13 |
| 2,825,465 | 3/1958 | Burge | 211/40 |
| 2,868,386 | 1/1959 | Seyforth | 211/95 |
| 3,334,736 | 8/1967 | Cole et al. | 248/205.3 X |
| 4,264,013 | 4/1981 | Vollmer | 211/13 |
| 4,417,710 | 11/1983 | Adair | 248/205.2 |
| 4,573,585 | 3/1986 | Frei | 211/13 |

*Primary Examiner*—Ramon S. Britts

*Assistant Examiner*—Sarah A. Lechok Eley

*Attorney, Agent, or Firm*—Milton Gerstein

[57] ABSTRACT

A plurality of strip of stretchable knit or woven fabric are arranged in substantially parallel relationship and removably connected at its ends to a housing. Each strip may display a plurality of items of jewelry having pins that pierce through the fabric. The side edges of the strips of fabric are used for mounting clip on earrings. The ends of each strip are removably connected to a housing to allow easy attachment or removal thereof from the housing, so that each strip may be independently removed for carrying, exhibiting the jewelry thereon, and the like. The strips may be spaced apart so that projecting studs may project through the spaces in between in order to allow for rings to be displayed or stored thereby. The housing may also take the form of a pair spaced apart rotatable disks, so that each strip may be accessed more readily.

14 Claims, 5 Drawing Figures

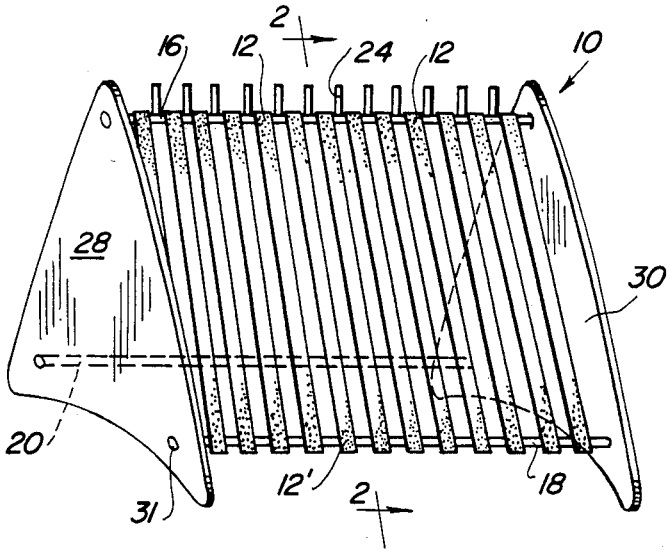
FIG. 1
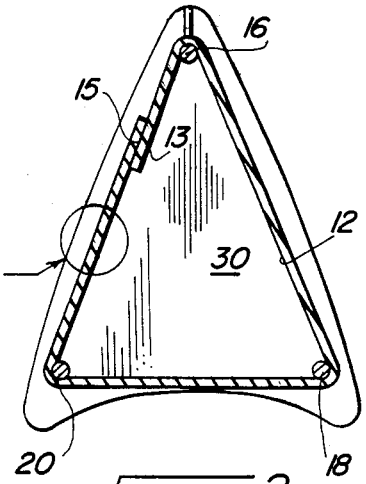
FIG. 5
FIG. 2
FIG. 3
FIG. 4
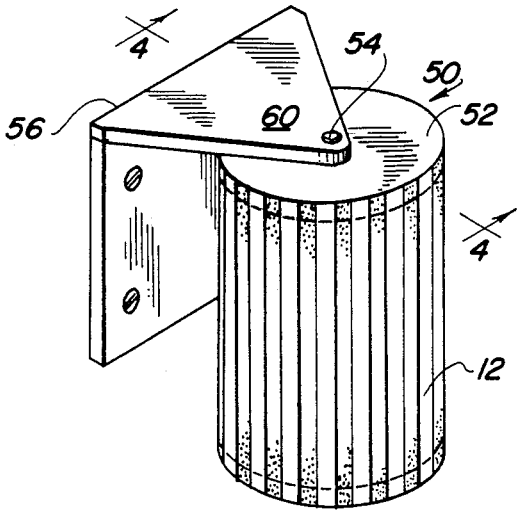
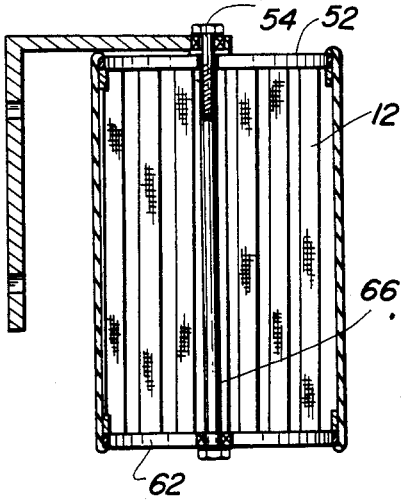
FIG. 5
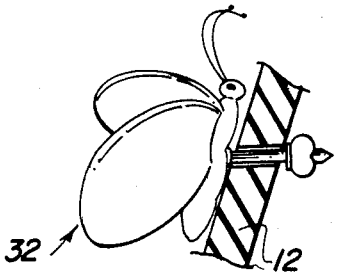

DISPLAY STAND FOR ITEMS OF JEWELRY

BACKGROUND OF THE INVENTION

The invention is directed to a storage rack or display stand by which items of jewelry may be displayed and stored, as well as to provide ease of access to and carrying of the items of jewelry. Jewelry display stands are well known and generally consist of fabric covered cardboard with punched holes for earring studs or plastic racks for hanging retail sales cards to which the earrings are attached. Jewelry display stands also include fabric covered cardboard with slots into which rings are inserted and plastic racks with vertical posts at the top from which bracelets and necklaces can be strung. These known stands present a disadvantage in that they are for display purposes and are not suited to be used as either storage or carrying racks.

SUMMARY OF THE INVENTION

It is, therefor, the primary objective of the present invention to provide a jewelry display stand that may arrange items of jewelry by compartments, and allow for easy removal of and carrying of the jewelry by compartment.

It is another objective of the present invention to provide such a display stand that will display and store earrings, both the clip-on and pierced-type, as well as other items of jewelry not having pins for piercing.

It is yet another objective of the present invention to provide a jewelry display stand or rack that in one embodiment allows for easy access to any item of jewelry by rotatably mounting the strips of fabric to which are attached the jewelry.

Towards these and other ends, the display rack of the present invention includes a plurality of stretchable strips of fabric, with each strip having at its ends attachment means for mounting the strips to a housing in substantially parallel arrangement. In a first embodiment of the invention, the housing consists of three parallel dowels or rods formed in an equilateral triangular array, over which dowels are wrapped each of the plurality of stretchable strips of fabric. Cooperating hook-and-pile fastening means formed at the first and second ends of each strip of fabric allow for easy assembly and disassembly of each strip about the three dowels, so that the jewelry on each strip may be readily and easily separated from the remainder of the strips, so that each strip may be defined as a compartment that allows one to quickly display or carry the jewelry, whether for personal or commercial purposes. Preferably, the strips of fabric are spaced apart, so that a plurality of projecting pins or studs may project through the spaces between the strips of fabric. The projecting studs project from a surface portion of one of the three dowels, which surface portion faces away from the other two dowels. These projecting studs may be used for holding and storing rings, necklaces, and the like.

In a second embodiment, the housing is defined by a pair of spaced apart, rotatable disks interconnected by a central hub section. Each of the disks has a thickness on the surfaces of which are provided the hook portion of a hook-and-pile fastener or the equivalent thereof. Each end of each strip of fabric is provided with the pile fabric portion of the hook-and-pile fastener, so that each strip of fabric may span the distance between the two disks, which strips of fabric are arranged parallel to each other about a cylindrical surface defined by the outer circumferential portions of the pair of disks. Access to any one of the strips of fabric is readily achieved by rotating the disks about a hinge, while removal of any strip is simply achieved by removing the ends thereof from the hook portions on the disks.

BRIEF DESCRIPTION OF THE DRAWING

The invention will be more readily understood with reference to the accompanying drawing, wherein FIG. 1 is a perspective view showing a first embodiment of the earring and jewelry display and storage rack according to the present invention;

FIG. 2 is a cross-sectional view taken along line 2—2 of FIG. 1;

FIG. 3 is a perspective view of a second embodiment of the earring and jewelry display and storage rack according to the present invention;

FIG. 4 is a cross-sectional view taken along line 4—4 of FIG. 3; and FIG. 5 is an enlarged detailed view showing an earring attached to one of the elastic, stretchable bands of the earring and jewelry display and storage rack according to the present invention.

DETAILED DESCRIPTION OF THE INVENTION

Referring now to the drawings in greater detail, wherein like reference numerals indicate like parts, a first embodiment of the present invention is shown in FIGS. 1 and 2, and is indicated generally by reference number 10. The storage rack 10 is made up of a plurality of parallel, triangularly-arrayed, flexible strips of fabric 12 spaced from each other along a triangular-arrayed supporting backing structure of three dowel or rod members 16, 18 and 20. The three dowel members 16 18,20 form what is preferably a equilateral triangular-array when viewing an end thereof, as seen in FIG. 2, though a different triangular arrangement may be used. Extending from the upper surface of the upper dowel member 16 are a plurality of spaced-apart projecting studs or shafts 24 which are used for storing and displaying rings, necklaces, and the like. The studs 24 define the separation between the plurality of flexible strips of fabric 12, which strips are used for storing and displaying earrings and other jewelry having a pin thereof, in the manner shown more clearly in FIG. 5. The fabric 12 is preferably a woven, polyester or nylon fabric, but clearly other fabrics could be used as well as most double and single knit fabrics, and even tricot fabrics.

Each strip of fabric 12 includes a pair of ends 13 and 15 best seen in FIG. 2, which pair of ends cooperate to attach the strip 12 about the three dowel or rod members 16,18,20. In the preferred embodiment, the pair of ends 13 and 15 form a hook-and-pile fastener, commonly known as "VELCRO". Of course, other end-fasteners may be used equally as well. By the fact that the pair of ends 13,15 are readily disassembled, it can be seen that each strip of fabric for displaying and storing earrings and other hooked jewelry pieces may readily, easily and safely be removed from its envelope about the three dowel members and be moved therefrom, for carrying as for travelling purposes, or simply for bringing the displayed items closer to a potential customer. The strip 12 may be readily and easily replaced and wrapped about the three dowel members for re-displaying and storing the items. The spaced-apart nature of the strips 12 allows for a much easier and fast removal of each strip from its envelope about the three dowel members, as well as for its easy and fast replacement.

A pair of side plates or brackets 28 and 30 are also provided which mount the ends of the three dowel members. Each side plate 28 and 30 is also preferably triangular in cross-section, and includes three triangularly-arrayed apertures for the insertion therein of a respective end of one of the three dowel members 16,18,20. Preferable, each aperture 31 is only slightly larger than an end of the dowel member, in order to allow for easy and simple disassembly of the side plates from the dowel members, so that the entire assembly may be knocked-down for shipping and transport and packaging. While three dowel members have been shown, it is to be understood that a quadrilateral-arrayed system may be used, as well as a polygonal one, though the triangular-array offers greater stability and more ready access to the jewelry since greater lengths of strips of fabric 12 extend between adjacent dowel members. In a slight modification of the embodiment of FIGS. 1 and 2, a hanger-element may be employed (not shown) such that a hook is provided above the upper dowel member 16, which hook of the hanger may be used for suspending the display stand from a bar, in a closet, and the like. It is to be appreciated that each strip of fabric 12 need not only serve to store, hold and display earrings of the pierced type. Conventional clamp-earrings may be stored and held by simply attaching the clamps of the earing along a side edge surface 12' such that the clamping pieces of the earring sandwich therebetween the strip of fabric 12. In addition to holding clip earrings, post-type earrings may also be held and displayed. Any earring may, in fact, be attached to the strip of fabric 12, as well as other jewelry items that attach similarly to earings, such as pins, tie clips, tie pins, and the like. FIG. 5 shows a post-type earring 32 attached to a strip 12.

A second embodiment of the invention is shown in FIGS. 3 and 4 and is indicated generally by reference numeral 50. The display stand 50 is a rotary one, and includes an upper rotary disk 52 rotatably mounted by a pivot pin 54 affixed to a bracket mount 56, which bracket mount includes a wall-attaching portion 58 and disk-supporting portion 60 at right angles to the portion 58. A lower disk 62 is also provided, which disk 62 is interconnected with the upper disk 52 via a central shaft or hub portion 66 best seen in FIG. 4. The pivot pin 54 is received in the upper hollow portion of the shaft 66 as shown in FIG. 4. Appropriate central apertures are provided in the two disks to allow for the passage therethrough of associated elements. The rack 50 is also provided with a plurality of strips 12 that may be spaced apart as shown in FIG. 4. Each strip 12 spans the distance between the upper disk 52 and the lower disk 62, with each end of each strip being attached to the circumferential rim of each disk which defines the thickness of the respective disk. To accomplish this, the rim portion, which constitutes an attaching surface, of each disk is provided with pile fabric to constitute one half of a hook-and-pile fastener. Each end of each strip 12 is provided with a hook portion of the hook-and-pile fastener, so that each strip may be readily and easily attached vertically between the two opposing disks 52 and 62. Preferably, they are spaced apart, as in the embodiment of FIG. 1. It may, therefore be seen that each strip 12 may be easily removed from its attached position, so that it may be more easily shown so that the jewelry thereon may be more easily presented to a potential customer, as well as to provide for compact storage and transport. The rack 50 is also capable of being disassembled by the removal of the pivot pin 54. Further, access to the jewelry on any strip 12 is easily achieved by the simple rotation of the unit 50 about the pivot pin 54.

While specific embodiments of the invention have been shown and described, it is to be understood that numerous changes and modifications may be made without departing from the scope and spirit of the invention as defined and set out in the appended claims, which appended claims constitute part of the disclosure.

What is claimed is:

1. A jewelry display and storage rack comprising:

a plurality of separate bands of substantially stretchable material being adjacently mounted on said rack, wherein each said band also comprises a first end and a second end and a first longitudinal side edge, and a second longitudinal side edge, said side edges extending parallel to each other and between said first and second ends, each said band having a substantial width for receiving pins pierced therethrough;

said side edges of said plurality of bands extending parallel to each other;

means for mounting said plurality of elongated bands adjacent to one another, each of said elongated bands comprising a first attaching means for removably securing at said first end thereof, and a second attaching means for removably securing at said second end thereof, said first and second attaching means mounting each of said plurality of bands to said means for readily mounting for repeated and selective attachment and detachment therefrom;

each of said plurality of elongated bands being made of a material allowing for the piercing therethrough of a pin from a piece of jewelry, whereby pins, earrings and other jewelry may be displayed and stored by said plurality of bands by the piercing of a pin of the jewelry therethrough;

said means for mounting said elongated bands positioning said bands such that substantially the entire length of each said band is accessible for storing and displaying jewelry thereon.

2. The jewelry display and storage rack according to claim 1, wherein said plurality of elongated bands are spaced apart such that each of said side edges of each said band is spaced from a said edge from the next band adjacent thereto; said means for mounting further comprising a plurality of projecting studs on which may be stored rings for display and storage, said plurality of studs being positioned in planes interspersed between said bands such that each said stud lies in a plane between a first plane containing therein said first edge surface of one of said bands and a second plane containing therein a second side edge of a neighboring adjacent band, said plurality of studs serving also to space apart said plurality of elongated bands.

3. The jewelry display and storage rack according to claim 2, wherein said means for mounting comprises three parallel, elongated mounting rods to form a triangular mounting array; said plurality of elongated bands encompassing said three rods in said spaced-apart manner; said plurality of bands being divided into three distinct lengths thereof by said three rods.

4. The jewelry display and storage rack according to claim 3, wherein said plurality of studs are mounted to and along one of said three mounting rods and project from a surface thereof facing away from the other two of said mounting rods, said studs serving as guides by which the spaced-apart bands are wrapped about said three rods along the lengths of said rods.

5. The jewelry display and storage rack according to claim 4, wherein said means for mounting further comprises a first mounting bracket for mounting first ends of said three rods, and a second mounting bracket for mounting second ends of said three rods; said first and second mounting brackets extending substantially parallel to each other.

6. The jewelry display and storage rack according to claim 1, wherein each of said plurality of elongated bands is made of a woven fabric.

7. The jewelry display and storage rack according to claim 1, wherein said means for mounting comprises a first rotatable disk member having a thickness thereof, and a second rotatable disk member spaced from said first rotatable disk member; said first end of each of said plurality of elongated bands being removably connected to a portion of said thickness of said first disk member, and said second end of each of said plurality of elongated bands being removably connected to a portion of said second disk member opposite said portion of said first disk member to which is connected said first end; and means for rotatably mounting said first disk member so that said second disk member and interconnecting bands are rotated therewith.

8. The jewelry display and storage rack according to claim 7, wherein said portions of said first and second disk members comprise hook means, and each of said first and second ends of each of said bands comprises pile means to form hook-and-pile fastening means.

9. The jewelry display and storage rack according to claim 8, wherein said means for mounting further comprises a central hub member interconnecting central sections of said first and second disk members to provide structural enhancement thereto.

10. The jewelry display and storage rack according to claim 5, wherein each of said first and second mounting brackets comprises at least three triangularly-arrayed holes for mounting respective ends of said three mounting rods therein, wherein said ends of said rods are easily removable from said holes to provide easy disassembly for packing, shipping, and the like.

11. The jewelry display and storage rack according to claim 10, wherein each of said first attaching means comprises hook-fabric means, and each of said second attaching means comprises pile-fabric means, whereby said first and second ends of each of said plurality of elongated bands form together hook-and-pile fastening means, the length of each said band between said first and second ends thereof being long enough to allow for the overlapping of said ends when said band is wrapped about said three rods to thereby afford a detachable band.

12. The jewelry display and storage rack according to claim 11, wherein each of said elongated bands is made of a stretchable knitted fabric.

13. The jewelry display and storage rack according to claim 7, wherein said means for mounting further comprises means for connecting said means for rotatably mounting said first disk member to a surface whereby said first and second disk members may be rotated freely.

14. The jewelry display and storage rack according to claim 13, wherein said plurality of elongated bands are mounted edge-to-edge so that said first edge of each of said bands is substantially in contact with said second edge of neighboring one of said bands.

* * * * *